United States Patent [19]

Harnish

[11] Patent Number: 4,498,622

[45] Date of Patent: Feb. 12, 1985

[54] QUICK RECOVERY HEAT PUMP WATER HEATER

[75] Inventor: James R. Harnish, York, Pa.

[73] Assignee: Borg-Warner Corporation, Chicago, Ill.

[21] Appl. No.: 497,481

[22] Filed: May 23, 1983

[51] Int. Cl.[3] ..... F28F 27/00

[52] U.S. Cl. ..... 236/25 R; 62/238.6; 126/362; 237/2 B

[58] Field of Search ..... 126/344, 362, 366, 421, 126/422, 437; 62/181, 183, 238.6, 324.5; 237/2 B, 8 A, 19, 56, 61, 59, 63; 165/18, 29; 236/20 R, 25 R; 122/13 R, 18; 219/331

[56] References Cited

U.S. PATENT DOCUMENTS

| | | | |
|---|---|---|---|
| 2,716,866 | 9/1955 | Silva | 165/29 X |
| 4,313,419 | 2/1982 | Lyon et al. | 126/421 |
| 4,314,456 | 2/1982 | Harnish | 62/181 |
| 4,330,309 | 5/1982 | Robinson | 62/181 |
| 4,385,723 | 5/1983 | Sanborn et al. | 62/238.6 X |
| 4,390,008 | 6/1983 | Andrews | 126/437 X |
| 4,416,222 | 11/1983 | Staats | 62/238.6 X |

FOREIGN PATENT DOCUMENTS

| | | | |
|---|---|---|---|
| 3027609 | 2/1982 | Fed. Rep. of Germany | 62/238.6 |

*Primary Examiner*—Margaret A. Focarino
*Attorney, Agent, or Firm*—Julian Schachner

[57] ABSTRACT

A quick recovery heat pump water heater includes a water storage tank with first and second tank portions, and sensing means for indicating the demand for hot water in the tank portions. A water pump and an external heat source are provided. Control means responsive to an indication from the sensing means of a demand for hot water in the first tank portion initially establishes communication of the first tank portion with the pump and external heat source and turns them on. The control means then responds to an indication from the sensing means that the demand for hot water in the first tank portion has been satisfied and establishes communication of the second tank portion with the pump and external heat source. Finally, the control means is responsive to an indication from the sensing means that the demand for hot water in the second tank portion has been satisfied and turns off the pump and external heat source.

10 Claims, 5 Drawing Figures

Fig. 1.
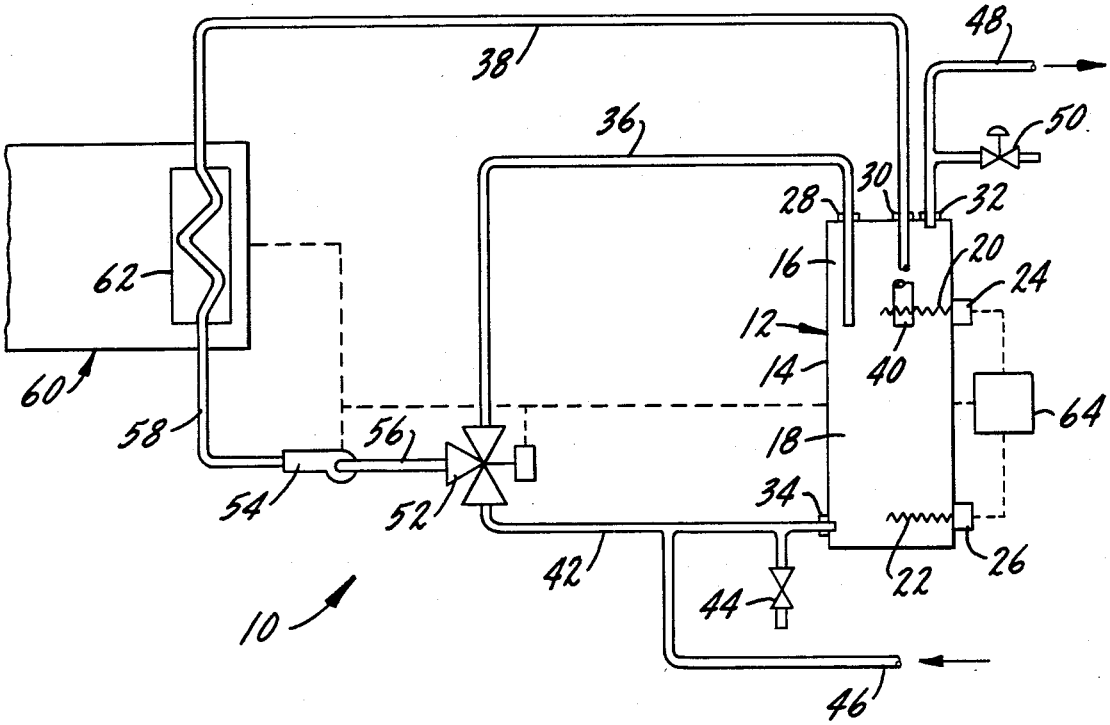
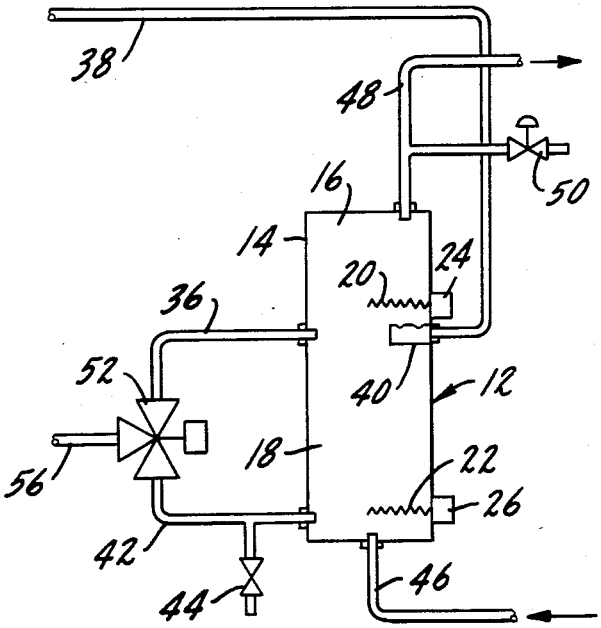
Fig. 2.
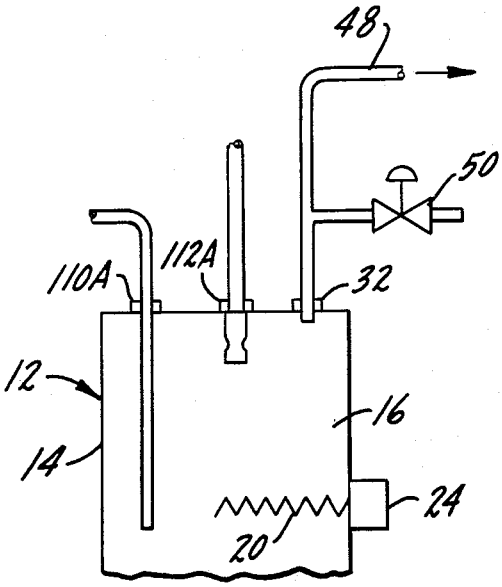
Fig. 5.

QUICK RECOVERY HEAT PUMP WATER HEATER

BACKGROUND OF THE INVENTION

This invention relates generally to a water heater. More particularly, it relates to a quick recovery water heater which incorporates an external heat source, for example a heat pump, and which is adapted for use in a domestic water supply system.

The typical domestic electric water heater includes a water storage tank having a tank heating unit provided with upper and lower heating devices, generally electric resistance heating elements, respectively associated with upper and lower tank thermostats. The arrangement is such that water in the upper portion of the tank is heated until the upper tank thermostat is satisfied, and then water in the lower portion of the tank is heated until the lower tank thermostat is satisfied. As a result, a limited supply of hot water is replenished in a relatively short period of time, to the extent of the capacity of the upper portion of the tank.

The heat pump has been known for many years. It is generally more economical to operate than a conventional tank heating unit. However, the heat pump has not been used extensively heretofore because power, particularly electric power, has been inexpensive. As the cost of power increases, there is renewed interest in the use of a heat pump in association with a water heater, especially for providing domestic hot water.

When a heat pump is used in association with a water heater, it is advantageous to make the heat pump responsive to the tank thermostats as an indicator of the demand for hot water. Arrangements of this nature are disclosed in U.S. Pat. No. 4,314,456 issued Feb. 9, 1982, U.S. application Ser. No. 416,435 filed Sept. 10, 1982 and U.S. application Ser. No. 450,499 filed Dec. 16, 1982. All are of common assignee herewith and are incorporated herein by reference.

The U.S. Pat. No. 4,314,456 requires both a thermostatically operated valve and a by-pass valve. Water leaving the heat pump is maintained at an elevated temperature until the demand in the upper portion of the tank has been satisfied. An inherent disadvantage of this is that the heat pump is least efficient when operating at an elevated temperature.

Neither of the two U.S. application Ser. Nos. 416,435 or 450,499 provides for rapid replenishment of hot water in the upper portion of the tank. Rather, each uses a heat pump to heat an entire tank of water in a single batch. This arrangement necessarily does not provide for quick recovery; that is, it does not provide for rapid replenishment of the supply of water stored in the upper portion of the tank. Operation in this manner also is inefficient.

There remains a need in the art for a quick recovery heat pump water heater which will initially heat water in the upper portion of a water storage tank, and subsequently heat water in the lower portion of the tank. It should operate efficiently, and should be responsive to the tank thermostats as an indicator of the demand for hot water. It should be conducive to installation on-site in the field as an adjunct to an existing conventional domestic water heater.

SUMMARY OF THE INVENTION

The object of this invention is to meet this need. To that end, there is disclosed a quick recovery heat pump water heater in the form of a domestic water heater combined with an external heat source such as a heat pump. When there is a demand for hot water, the heat pump is cycled on to first heat water in the upper portion of the tank, and then heat water in the lower portion of the tank. When the demand for water has been satisfied, the heat pump is cycled off automatically.

The tank heating unit of the water heater is not modified, but nevertheless its tank thermostats are used as indicators of the demand for hot water.

In summary, the quick recovery heat pump water heater includes a water storage tank with first and second tank portions, and sensing means for indicating the demand for hot water in the tank portions. An external heat source includes a heat exchanger. Suitable means selectively communicates the tank with the heat exchanger and the heat exchanger with the tank. Pumping means is provided for pumping water from the tank through the communicating means and heat exchanger back to the tank. Control means responsive to an indication from the sensing means of a demand for hot water in the first tank portion initially establishes communication of the first tank portion with the heat exchanger and turns on the external heat source and pumping means. The control means then responds to an indication from the sensing means that the demand for hot water in the first tank portion has been satisfied and establishes communication of the second tank portion with the heat exchanger. Finally, the control means is responsive to an indication from the sensing means that the demand for hot water in the second tank portion has been satisfied and turns off the external heat source and pumping means.

BRIEF DESCRIPTION OF THE DRAWINGS

The objects and advantages of this invention will become apparent to those skilled in the art upon careful consideration of the specification herein, including the drawings, wherein:

FIG. 1 is a schematic illustration of the invention;

FIG. 2 is a partial schematic illustration, similar to FIG. 1, showing an alternative construction thereof;

FIG. 5 is a partial schematic illustration, similar to FIGS. 3 and 4, showing an alternative construction thereof.

Figure 3:
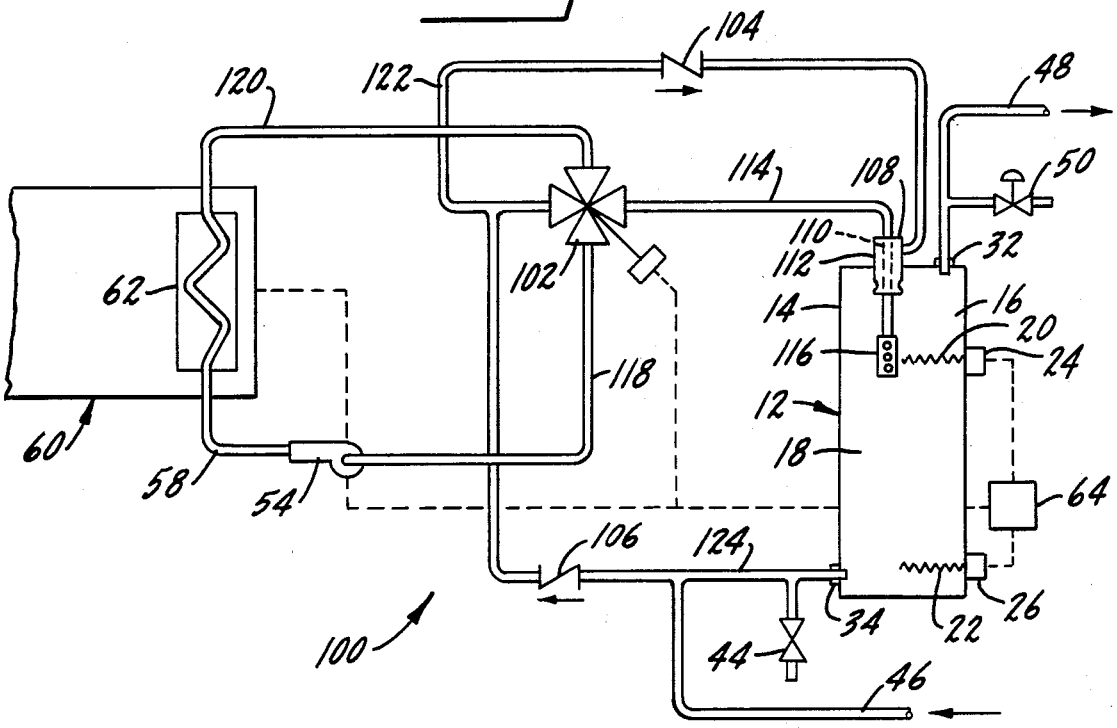
FIG. 3 is a schematic illustration of the invention in a modified form.

While this invention is susceptible of embodiment in many different forms, a preferred embodiment is shown in the drawings and described in detail. It should be understood that the present disclosure is considered to be an exemplification of the principles of the invention, and is not intended to limit the invention to this embodiment.

DESCRIPTION OF THE PREFERRED EMBODIMENT

Turning now to the drawings in greater detail, and to FIG. 1 in particular, reference numeral 10 indicates the quick recovery heat pump water heater of this invention. The invention includes a water heater 12 having a tank 14 with an upper portion 16 and a lower portion 18. Upper tank portion 16 encompasses approximately the upper one-third of tank 14. Lower tank portion 18 encompasses approximately the lower two-thirds of tank 14.

In a conventional manner, tank 14 is provided with a tank heating unit including upper and lower heating elements 20 and 22 respectively. Heating element 20 extends into tank 14 and is located at approximately the boundry between upper tank portion 16 and lower tank portion 18. That is, it is located at approximately the bottom of upper portion 16. Lower heating element 22 extends into tank 14 and is located at approximately the bottom thereof. That is, it is located at approximately the bottom of lower portion 18. Upper and lower tank thermostats 24 and 26 are associated respectively with upper and lower heating elements 20 and 22.

A conventional tank 14 might be provided with four fittings. A first fitting 28 typically would provide a connection for a make-up water inlet. A second fitting 30 typically would provide a connection for a pressure relief valve. A third fitting 32 typically would provide a connection for a hot water delivery outlet. A fourth fitting 34 typically would provide a connection for a drain line. As shown in FIG. 1, these fittings are used in a different arrangement which will be explained.

A first water line 36 extends through fitting 28 into tank 14 and terminates at approximately the bottom of upper portion 16. A second water line 38 extends through fitting 30 into tank 14 and also terminates at approximately the bottom of upper portion 16. If desired, line 38 may be provided with a diffuser 40. A third water line 42 extends through fitting 34 into tank 14 and terminates at approximately the bottom of lower portion 18. A drain valve 44 is in communication with line 42. A suitable pipe 46 in communication with line 42 serves as a make-up water inlet for tank 14. If desired, pipe 46 could be arranged to extend through a suitable fitting directly into tank 14, where make-up water would be sure to mix with the water in storage before entering line 42. A suitable pipe 48 extending through fitting 32 into tank 14 serves as a hot water supply outlet. A pressure relief valve 50 communicates with pipe 48.

At this point it should be emphasized that tank 14 may be a conventional domestic hot water heater tank. The tank may be modified simply and easily on-site in the field to provide the various water connections noted.

A three-way valve 52 communicates with water lines 36 and 42. Valve 52 also communicates with the inlet of a suitable water pump 54 through a fourth water line 56. A fifth water line 58 is in communication with the outlet of pump 54.

An external heat source 60 is preferably in the form of a heat pump. A suitable heat pump may be of the type disclosed in the aforementioned U.S. Pat. No. 4,314,456 or U.S. application Ser. Nos. 416,435 and 450,499. Suffice to say that heat pump 60 includes a heat exchanger 62, in the form of a water-cooled refrigerant condensor, communicating with lines 58 and 38.

Suitable control means 64 is responsive to thermostats 24 and 26 for controlling valve 52, water pump 54 and heat pump 60. Details of control means 62 are not critical to the invention herein. It may be similar to that disclosed in the aforementioned U.S. Pat. No. 4,314,456 or U.S. application Ser. Nos. 416,435 and 450,499.

In use, hot water is drawn from tank 14 through supply pipe 48. Make-up water for tank 14 is received through pipe 46 and line 42.

The operating cycle is initiated when upper thermostat 24 indicates that there is a demand for hot water in upper tank portion 16. In response to this indication, control means 64 turns on water pump 54 and heat pump 60. Control means 64 also actuates valve 52 so as to place line 36 in communication with line 56. Water is directed from upper portion 16 through line 36, valve 52, line 56, pump 54 and line 58 to heat pump 60. The water is heated as it passes through condensor 62, and returns through line 38 to upper portion 16 of tank 14.

This cycle continues until thermostat 24 indicates that the demand for hot water in upper portion 16 has been satisfied. Control means 64 then respondes to an indication from lower thermostat 26 that there is a demand for hot water in lower tank portion 18. Control means 64 actuates valve 52 in order to communicate line 42 with line 56. Water is directed from lower portion 18 through line 42, valve 52, line 56, pump 54 and line 58 to heat pump 60. After being heated in condensor 62, water is returned through line 38 to tank 14. When water in lower portion 18 reaches the desired temperature, thermostat 26 will so indicate, and control means 64 responds by turning off water pump 54 and heat pump 60, thereby concluding the operating cycle.

It should be apparent that initially the hot water in upper portion 16 is replenished, and subsequently the hot water in lower portion 18 is replenished. This arrangement provides quick recovery of a supply of hot water for domestic use, which supply is determined by the capacity of upper portion 16.

Thus, as shown in FIG. 1, the quick recovery heat pump water heater of this invention includes hot water heater 12, which may be modified easily in the field, external heat source 60, water pump 54, three-way automatically controlled valve 52, control means 64 and suitable water lines. Tank thermostats 24 and 26 are used as indicators of the demand for hot water respectively in the upper and lower portions of tank 14. This is accomplished without modification of the tank heating unit.

FIG. 2 shows in a simple manner how tank 14 might be constructed if the quick recovery heat pump water heater is provided as an original equipment item for the new construction market, or for the replacement market. It might be simpler to construct the equipment such that lines 36 and 38 enter tank 14 through the sides thereof at the level of approximately the bottom of upper portion 16. This would eliminate much of the internal plumbing within the tank.

FIG. 3 shows a modification 100 of the invention in which three-way valve 52 is replaced by a four-way automatically controlled valve 102 and two check valves 104 and 106. If desired, the fittings for tank 14 may be modified, as will be described.

Tank 14 may be provided with a dual fitting 108 having an inner flow passage 110 and an outer flow passage 112. Fitting 108 replaces fitting 28 and 30. A water line 114 is in communication with valve 102 and extends through inner passage 110 into tank 14, where it may be provided with a suitable diffuser 116. Line 114 terminates at approximately the bottom of upper portion 16.

A water line 118 communicates valve 102 with the inlet of pump 54. A water line 120 communicates the outlet of condenser 62 with valve 102. A water line 122 communicates valve 192 with outer passage 112 of fitting 108, and thus with upper portion 16 of tank 14. Check valve 104 in line 122 prevents reverse flow from tank 14. A water line 124 extends through fitting 34 into tank 14 at the level of approximately the bottom of lower portion 18. Line 124 communicates with valve 102 and is provided with check valve 106 to prevent reverse flow from valve 102.

The operating cycle is initiated when upper thermostat 24 indicates that there is a demand for hot water in upper tank portion 16. In response to this indication, control means 64 turns on water pump 54 and heat pump 60. Control means 64 also actuates valve 102 so as to place line 114 in communication with line 118. Water is directed from upper portion 16 through line 114, valve 102, line 118, pump 54 and line 58 to heat pump 60. The water is heated as it passes through condenser 62, and returns through line 120, valve 102 and line 122 to upper portion 16 of tank 14.

This cycle continues until thermostat 24 indicates that the demand for hot water in upper portion 16 has been satisfied. Control means 64 then responds to an indication from lower thermostat 26 that there is a demand for hot water in lower tank portion 18. Control means 64 actuates valve 102 in order to communicate line 124 with line 118. Water is directed from lower portion 18 through line 124, valve 102, line 118, pump 54 and line 58 to heat pump 60. After being heated in condenser 62, water is returned through line 120, valve 102 and line 114 to tank 14. When water in lower portion 18 reaches the desired temperature, thermostat 26 will so indicate, and control means 64 responds by turning off water pump 54 and heat pump 60, thereby concluding the operating cycle.

Thus, it should be apparent that operation of the modified water heater as shown in FIG. 3 is essentially similar to operation of the water heater as shown in FIG. 1.

Figure 4:
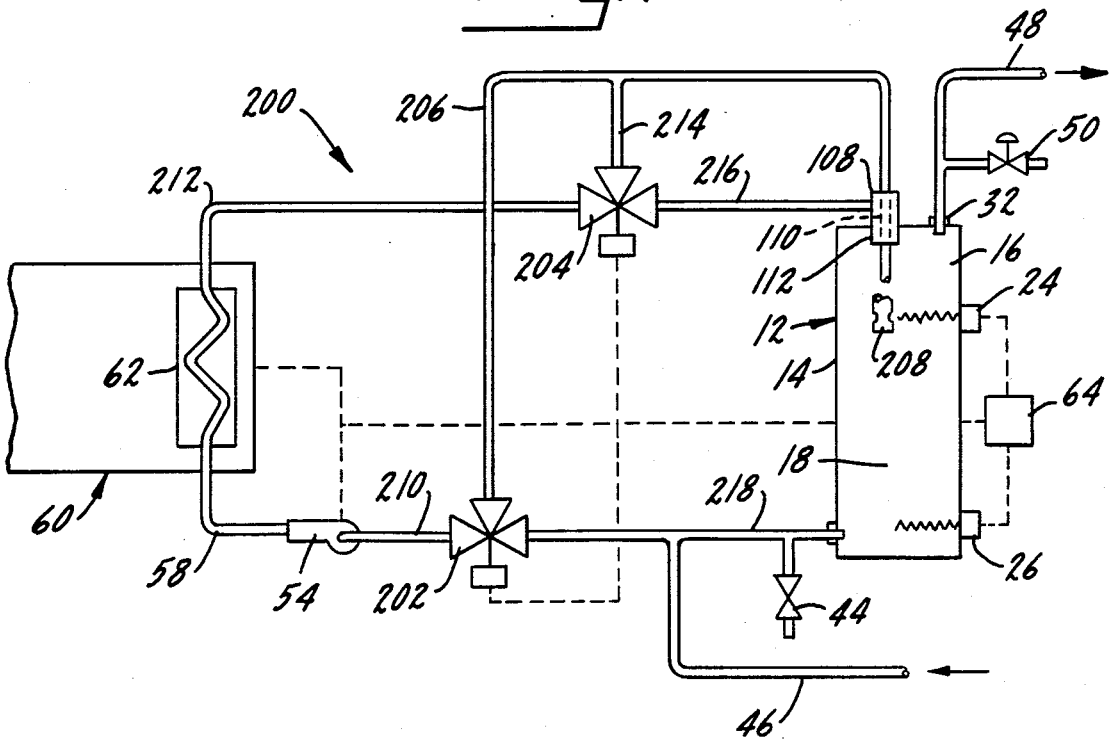
FIG. 4 is a schematic illustration of the invention in another modified form.

FIG. 4 shows a modification 200 of the invention in which three-way valve 52 is replaced by two three-way automatically controlled valves 202 and 204. The choice of fittings for tank 14 is again optional. For convenience, dual fitting 108 is shown.

A water line 206 extends through inner passage 110 into tank 14. Line 206 terminates at approximately the bottom of upper portion 16, where it may be provided with a suitable diffuser 208. Line 206 communicates with first three-way valve 202. A water line 210 communicates valve 202 with the inlet of pump 54.

A water line 212 communicates condenser 62 with second three-way valve 204. A water line 214 communicates valve 204 with line 206. A water line 216 extends through outer passage 112 into tank 14. Line 218 communicates with valve 202.

The operating cycle of modification 200 is essentially similar to that of modifications 10 and 100. The operating cycle is initiated when upper thermostat 24 indicates that there is a demand for hot water in upper tank portion 16. In response to this indication, control means 64 turns on water pump 54 and heat pump 60. Control means 64 also actuates valves 202 and 204. Valve 202 is actuated to place line 206 in communication with line 210. Valve 204 is actuated to place line 212 in communication with line 216. Water is directed from upper portion 16 through line 206, valve 202, line 210, pump 54 and line 58 to heat pump 60. The water is heated as it passes through condenser 62, and returns through line 212, valve 204 and line 216 to upper tank portion 16.

This cycle continues until thermostat 24 indicates that the demand for hot water in upper portion 16 has been satisfied. Control means then responds to an indication from lower thermostat 26 that there is a demand for hot water in lower tank portion 18. Control means 64 actuates valve 202 in order to communicate line 218 with line 210, and actuates valve 204 in order to communicate line 212 with line 214. Water is directed from lower portion 18 through line 218, valve 202, line 210, pump 54 and line 58 to heat pump 60. After being heated in condenser 62, water is returned through line 212, valve 204 and lines 214 and 206 to tank 14. When water in lower portion 18 reaches the desired temperature, thermostat 26 will so indicate, and control means 64 responds by turning off water pump 54 and heat pump 60, thereby concluding the operating cycle.

FIG. 5 shows how the modifications 100 and 200 shown in FIGS. 3 and 4 may be adapted for on-site installation in the field. Fitting 108 is modified by separating passages 110 and 112, 110 being in the form of a single fitting 110A and 112 being in the form of a single fitting 112A. This arrangement would render modifications 100 and 200 compatible with modification 10 shown in FIG. 1 for on-site installation in the field with a conventional domestic hot water heater. Of course, suitable diffusers may be provided, as desired.

It will be apparent to those skilled in the art that the invention disclosed herein provides a simple, efficient, easily constructed and installed quick recovery heat pump water heater. The heater is readily adaptable for production either as an equipment package for the new construction and replacement markets, or as an after-market package for on-site connection to an existing domestic hot water heater.

It should be understood that while a preferred embodiment of this invention has been shown and described, it is to be considered as illustrative and may be modified by those skilled in the art. It is intended that the claims herein cover all such modifications as may fall within the spirit and scope of the invention.

What is claimed is:

1. A quick recovery water heater comprising a water storage tank defining first and second tank portions, sensing means for indicating the demand for hot water in said first and second tank portions, an external heat source including a heat exchanger having a water inlet and a water outlet, means for selectively communicating said first and second tank portions with said water inlet and for communicating said water outlet with said tank, means for pumping water from said tank through said communicating means to said water inlet and from said water outlet to said tank, and control means for said communicating means, said control means being responsive to an indication from said sensing means of a demand for hot water in said first tank portion for initially establishing communication of said first tank portion with said water inlet and turning on said external heat source and pumping means, said control means being responsive to an indication from said sensing means that the demand for hot water in said first tank portion has been satisfied for subsequently establishing communication of said second tank portion with said water inlet, and said control means being responsive to an indication from said sensing means that the demand for hot water in said second tank portion has been satisfied for turning off said external heat source and pumping means.

2. The quick recovery water heater of claim 1, said first and second tank portions respectively being upper and lower tank portions, and said sensing means including upper and lower tank thermostats.

3. The quick recovery water heater of claim 2, said communicating means including water lines and valve means for establishing communication selectively from said upper and lower tank portions to said water inlet and from said water outlet to said tank, said valve means being subject to actuation by said control means for establishing said selective communication in response to said indications from said tank thermostats.

4. The quick recovery water heater of claim 3, one of said water lines communicating said water outlet with said tank, and said valve means including a three-way valve communicating said upper tank portion with said water inlet in one position thereof, and communicating said lower tank portion with said water inlet in another position thereof.

5. The quick recovery water heater of claim 3, said valve means including a four-way valve communicating said upper tank portion with said water inlet and said water outlet with said tank in one position thereof, and communicating said lower tank portion with said water inlet and said water outlet with said tank in another position thereof.

6. The quick recovery waterheater of calim 3, said valve means including first and second three-way valves, said first valve communicating said upper tank portion with said water inlet and said second valve communicating said water oulet with said tank in one position thereof, and said first valve communicating said lower tank portion with said water inlet and said second valve communicating said water outlet with said tank in another position thereof.

7. The quick recovery water heater of claim 1, further comprising a make-up water pipe communicating with said second tank portion, and a hot water delivery pipe communicating with said first tank portion.

8. The quick recovery water heater of claim 4, said one water line communicating said water outlet with said tank at approximately the bottom of said upper tank portion.

9. The quick recovery water heater of claim 5, said valve communicating said water outlet with said upper tank portion in said one position thereof, and communicating said water outlet with said lower tank portion in said other position thereof.

10. The quick recovery water heater of claim 6, said second valve communicating said water outlet with said upper tank portion in said one position thereof, and communicating said water outlet with said lower tank portion in said other position thereof.

* * * * *

UNITED STATES PATENT AND TRADEMARK OFFICE

CERTIFICATE OF CORRECTION

PATENT NO. : 4,498,622

DATED : February 12, 1985

INVENTOR(S) : JAMES R. HARNISH

It is certified that error appears in the above—identified patent and that said Letters Patent is hereby corrected as shown below:

Column 4, line 66, cancel "192" and insert -- 102 --.

Column 7, line 23, cancel "waterheater" and insert -- water heater --.

Signed and Sealed this

Second Day of July 1985

[SEAL]

*Attest:*

DONALD J. QUIGG

*Attesting Officer*

*Acting Commissioner of Patents and Trademarks*